United States Patent [19]

Diaz

[11] Patent Number: 4,776,761

[45] Date of Patent: Oct. 11, 1988

[54] ARTICULATED BLADES CEILING FAN-LAMPS COMBINATION

[76] Inventor: Octavio Diaz, P.O. Box 1270, Toa Alta, P.R. 00758

[21] Appl. No.: 77,663

[22] Filed: Jul. 24, 1987

[51] Int. Cl.[4] ..... F04D 29/34

[52] U.S. Cl. ..... 416/5; 416/89; 416/142

[58] Field of Search ..... 416/142 R, 5, 87, 89

[56] References Cited

U.S. PATENT DOCUMENTS

| | | | |
|---|---|---|---|
| 116,419 | 6/1871 | Drane et al. | 416/87 |
| 186,243 | 1/1877 | Fowler | 416/142 |
| 213,644 | 3/1879 | Feldman | 416/142 X |
| 316,655 | 4/1885 | Pittman | 416/170 C X |
| 377,573 | 2/1888 | Murray | 416/142 R |
| 1,361,785 | 12/1920 | Tucker | 416/142 R |
| 2,245,015 | 6/1941 | Sibal | 416/5 |
| 2,990,149 | 6/1961 | Samms | 416/142 X |
| 3,401,874 | 9/1968 | Covington | 416/142 |
| 3,455,540 | 7/1969 | Marcmann | 416/142 |
| 3,559,962 | 2/1971 | Enssle et al. | 416/142 X |
| 4,394,109 | 7/1983 | Ritchie | 416/142 |
| 4,427,341 | 1/1984 | Eichler | 416/87 X |

FOREIGN PATENT DOCUMENTS

| | | | |
|---|---|---|---|
| 136635 | 3/1950 | Australia | 416/170 C |
| 413673 | 5/1946 | Italy | 416/142 |
| 525859 | 5/1955 | Italy | 416/5 |
| 34929 | 10/1911 | Sweden | 416/87 |
| 500363 | 5/1976 | U.S.S.R. | 416/87 |
| 740975 | 6/1980 | U.S.S.R. | 416/142 |

*Primary Examiner*—Everette A. Powell, Jr.
*Attorney, Agent, or Firm*—Richard L. Miller

[57] ABSTRACT

A ceiling fan is provided and includes articulated fan blades such that when the fan is off the blades will hang vertically downwardly by force of gravity and when the fan is turned on the blades will rise radially to a horizontal pitched angled position due to the coaction of centrifugal force, and wind reaction force.

3 Claims, 1 Drawing Sheet

ARTICULATED BLADES CEILING FAN-LAMPS COMBINATION

BACKGROUND OF THE INVENTION

The instant invention relates generally to ceiling fans and more specifically it relates to a ceiling fan with articulated fan blades.

Numerous ceiling fans have been provided in the prior art that are adapted to contain fixed horizontal fan blades in which the appearance of these relatively large blades is aesthetically questionable, especially for domestic use. For example, U.S. Pat. Nos. 213,644 to Feldman et al; 316,655 to Pittman; 377,573 to Murray; 1,316,785 to Tucker; 1,728,768 to O'Connor; 2,245,015 to Sibal; 3,401,874 to Covington; 3,455,540 to Marcmann; 3,559,962 to Enssle et al, and foreign patents Nos. 136,635 Knoche of Australia; 658,619 to Heller of France; 413,673 to Gazzolo of Italy; 500,367 & 740,975 both of Russia; 34,929 to Hultman of Sweden all are illustrative of such prior art. While these units may be suitable for the particular purpose to which they address, they would not be as suitable for the purpose of the present invention as hereafter described.

SUMMARY OF THE INVENTION

A primary object of the present invention is to provide a ceiling fan with articulated fan blades that will overcome the shortcomings of the prior art devices.

Another object is to provide a ceiling fan with articulated fan blades such that when the fan is off the blades with hangs vertically downwardly by force of gravity acting as a decorative curtain.

An additional object is to provide a ceiling fan with articulated fan blades such that when the fan is turned on the blades will rise radially to a horizontal pitched angled position by centrifugal force thus creating a wind reaction force to ambient air around the fan.

A further object is to provide a ceiling fan with lamp having articulated fan blades that is simple and easy to use.

A still further object is to provide a ceiling fan with lamp having articulated fan blades that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
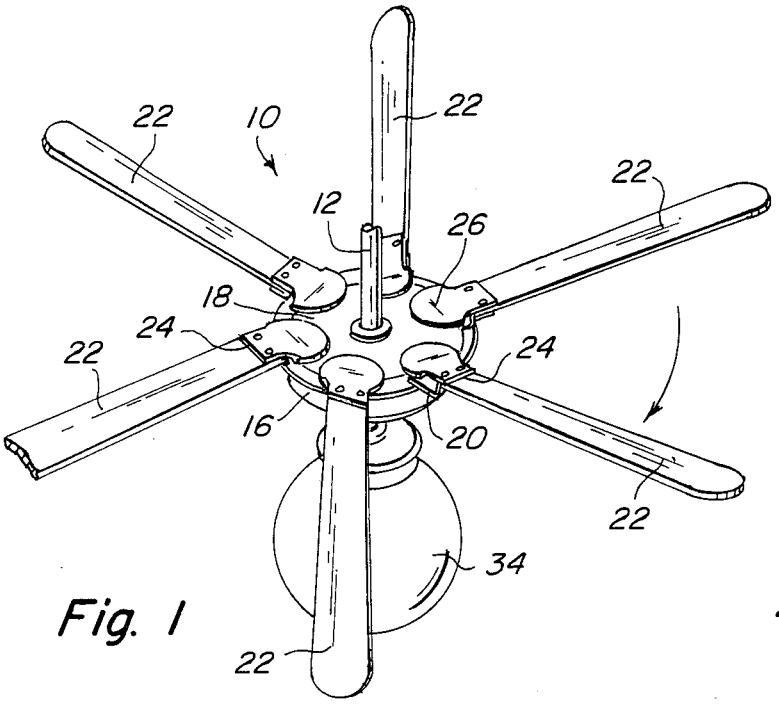
FIG. 1 is a perspective of the invention open showing the blades open while spinning.
Figure 2:
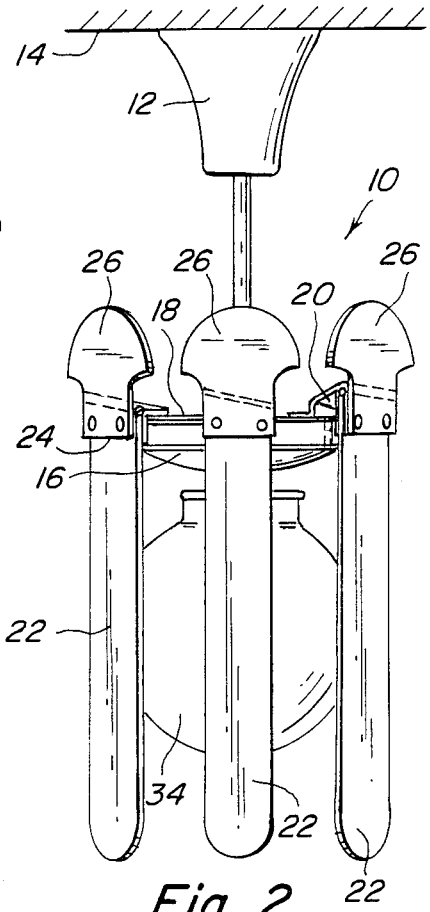
FIG. 2 is a side view of the invention at rest.
Figure 3:
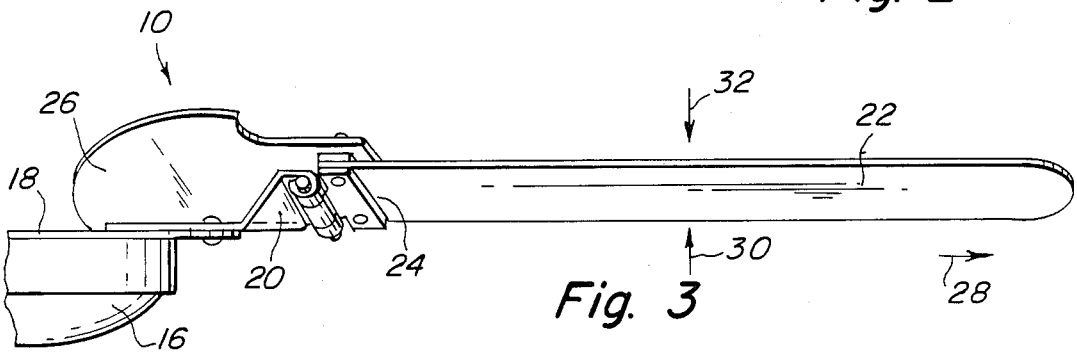
FIG. 3 is an enlarged view of a single blade assembly.
Figure 4:
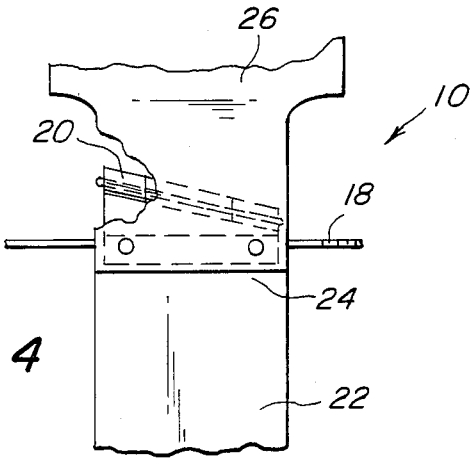
FIG. 4 is an enlarged view of a typical hinge assembly in greater detail.

Turning now descriptively to the drawings, in which like reference characters denote like elements throughout the several views, FIGS. 1 through 4 illustrate 2 ceiling fan 10 consisting of a hanger 12 suspended from a ceiling 14, an electric driving motor 16 mounted to the hanger 12, a hub 18 attached coaxially to the motor 16 a plurality of angularly pitched hinge brackets 20, each radially attached to the hub 18 and a plurality of fan blades 22. Each fan blade is articulated at one end 24 to one of the hinge brackets 20. The hinge bracket will permit free rotation of the fan blade 22 from a relatively vertical unpitched position, as shown in FIGS. 2 and 4 to a relatively horizontal running pitched position, as shown in FIG. 1 and 3.

A plurality of counter balance plates 26 are also provided in which each is disposed at the articulated end 24 of one of the fan blades 22. An air flow pattern of the fan 10 is predetermined by the running position of the fan blade 22 relative to a horizontal plane as indicated in FIG. 3. Centrifugal force shown by arrow 28, and upward wind reaction force shown by arrow 30, caused by virtue of pitch angle of the fan blade 22, both coact together to counter balance gravitational force shown by arrow 32 so as to maintain the blades 22 in a horizontal position when running.

A lamp 34 is suspended from the motor 16 so that when the fan 10 is off the fan blades 22 will hang vertically around the lamp 34 acting as a decorative curtain as shown in FIG. 2.

Figure 5:
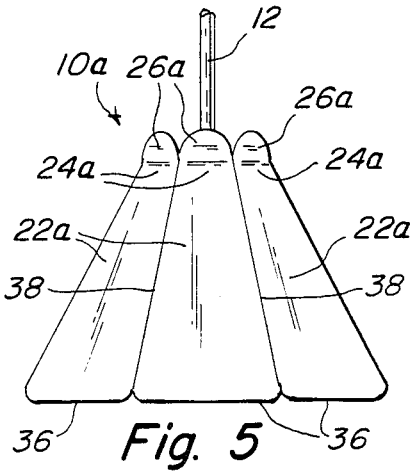
FIG. 5 is perspective view of a modified version of the invention with the blades at rest.

FIG. 5 is a modified ceiling fan 102 wherein each of the fan blades **22*a* is tapered from a relatively narrow width at the articulated end 24*a* to a relatively wide width at distal end 36. Each of the counter balance plates 26*a* are formed continuously from the articulated end 24*a* of each of the fan blades 22*a*. This provides an alternate appearance of the ceiling fan 10*a* while at rest in which the fan blades will bear against each other along their lengths 38 thereof in a relatively vertical inclined conical position. Except for the fan blades shape and rest position the construction and operation of the ceiling fan 10*a* is as identical to the ceiling fan 10** as described above.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A ceiling fan-lamp which comprises:

(a) a hanger suspended from a ceiling;

(b) an electric driving motor mounted to said hanger;

(c) a hub attached coaxially to said motor and rotatively driven by said motor;

(d) a plurality of angularly pitched hinge brackets, arcuately spaced apart and attached to said hub each hinge lying substantially tangential to said hub with one end of the hinge being raised in a horizontal plane above the other end of the hinge, (e) a plurality of longitudinal fan blades, each connected at one end to a respective hinge bracket wherein the hinge is connected to the blade along a line which is angularly positioned with respect to a longitudinal axis of the blade, whereby said hinge bracket will permit free rotation of said fan blade from a relatively vertical unpitched position to a relatively horizontal running pitched position, and counter balance plates connected to the blades adjacent to the hinge brackets.

2. A ceiling fan-lamp as recited in claim 1 further comprising a lamp suspended from said motor so that when said fan is off said fan blades will hang vertically around said lamp acting as a decorative curtain.

3. A ceiling fan-lamp as recited in claim 2 wherein each of said fan blades is tapered from a relatively narrow width at the articulated end to a relatively wide width at distal end and each of said counter balance plates are formed continuously from the articulated end of each of said fan blades so as to, provide an alternate appearance of said ceiling fan while at rest in which said fan blades will bear against each other along their lengths thereof in a relatively vertical inclined conical position.

* * * * *